US007497655B1

(12) United States Patent
Liang

(10) Patent No.: US 7,497,655 B1
(45) Date of Patent: Mar. 3, 2009

(54) TURBINE AIRFOIL WITH NEAR-WALL IMPINGEMENT AND VORTEX COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 401 days.

(21) Appl. No.: 11/508,008

(22) Filed: Aug. 21, 2006

(51) Int. Cl.
*F01D 5/14* (2006.01)
*F04D 29/38* (2006.01)

(52) U.S. Cl. ..... 415/1; 415/115; 416/1; 416/97 R; 416/233; 416/229 A

(58) Field of Classification Search ..... 415/1, 415/115; 416/1, 95, 96 R, 96 A, 97 R, 97 A, 416/232, 229 R, 229 A, 233
See application file for complete search history.

(56) References Cited

U.S. PATENT DOCUMENTS 3,540,810 A * 11/1970 Kercher ..... 416/90 R
3,781,129 A 12/1973 Aspinwall
3,782,852 A * 1/1974 Moore ..... 416/97 R
3,806,275 A 4/1974 Aspinwall
4,056,332 A 11/1977 Meloni
4,063,851 A 12/1977 Weldon
4,183,716 A * 1/1980 Takahara et al. ..... 416/96 A
4,252,501 A * 2/1981 Peill ..... 415/115
4,257,734 A * 3/1981 Guy et al. ..... 415/115
4,697,985 A 10/1987 Suzuki
5,259,730 A * 11/1993 Damlis et al. ..... 416/96 A
5,511,937 A 4/1996 Papageorgiou
5,516,260 A 5/1996 Damlis et al.
6,120,244 A 9/2000 Fukura
6,742,991 B2 6/2004 Soechting et al.
6,769,875 B2 8/2004 Tiemann

* cited by examiner

*Primary Examiner*—Igor Kershteyn
(74) *Attorney, Agent, or Firm*—John Ryznic

(57) ABSTRACT

An apparatus and method for impingement cooling of a turbine vane, in which the vane includes an insert having a plurality of impingement cavities formed therein and in series such that cooling air flows from a first impingement cavity onto the wall for impingement cooling, and is then directed into the second impingement cavity and redirected for impingement cooling on another part of the wall. Supports for the insert form seals that direct cooling air from one impingement cavity into the next impingement cavity in the series. A trailing edge impingement cavity directs cooling air through holes to provide impingement cooling to the trailing edge region, the cooling air passing through a trailing edge discharge passage to cool the trailing edge. The insert is formed as a single piece, and has from 3 to 5 impingement cavities separated by ribs.

20 Claims, 1 Drawing Sheet

TURBINE AIRFOIL WITH NEAR-WALL IMPINGEMENT AND VORTEX COOLING

BACKGROUND OF THE INVENTION

1. Field of the Invention

The present invention relates generally to airfoils in a gas turbine engine, and more specifically to an insert located within a cooling air passage of a vane.

2. Description of the Related Art Including Information Disclosed Under 37 CFR 1.97 and 1.98

A gas turbine engine includes a turbine section in which a hot gas flow from the combustor passes into and reacts with multiple stages of rotor blades and stationary vanes or nozzles to extract mechanical energy from the engine. The efficiency of the gas turbine engine can be increased by providing a higher gas flow temperature. However, the temperature is limited to the materials used and the effective amount of cooling provided in the first stage of the turbine. Thus, to improve the efficiency of the engine, more effective cooling of the first stage of the turbine would be necessary if the materials used do not change. More effective use of the cooling air requires less cooling air bled off from the compressor, resulting in a more efficient compressor and therefore more efficient engine.

Since the stationary vanes are not rotating like the rotor blades, the vanes make use of inserts supported within the hollow space formed by the vane wall. Inserts provide for a cooling supply channel and, through a plurality of strategically placed cooling holes, provide impingement cooling on the inner wall of the vane. Impingement cooling of the inner wall of the vane is an effective method of transferring heat from the vane to the cooling air, since the cooling air is basically shot directly against the wall surface, resulting in a high turbulent flow.

U.S. Pat. No. 4,697,985 issued to Suzuki on Oct. 6, 1987 and entitled GAS TURBINE VANE discloses a turbine vane with a wall forming a hollow inside, and an insert supported within the hollow wall by ribs and spaced therefrom to form a cooling passage for cooling air. The insert includes a plurality of orifices that provide impingement cooling against the inner vane wall surface. The insert forms a single cooling supply passage within the vane and as a result requires a large amount of cooling air in order to eject air through all of the impingement holes. Another problem with this type of insert that is that, as the air is injected through the holes and into the flow channel (between the vane wall and the insert), the air must flow toward the trailing edge to escape. Allot of air builds up in the downstream direction and acts to prevent air passing out through the holes to impinge against the wall. Thus, the impingement effect is reduced and therefore the cooling effect is lower.

Some airfoils use multiple inserts in multiple cavities, such as U.S. Pat. No. 5,511,937 issued to Papageorgiou on Apr. 30, 1996 entitled GAS TURBINE AIRFOIL WITH A COOLING AIR REGULATING SEAL which discloses a turbine vane with a fore and an aft cavity each having an insert therein with impingement holes, the two cavities being separated by a rib. This multiple cavity design will reduce the above described cross flow problem, but still requires the large amount of cooling flow to eject air from all of the impingement holes.

U.S. Pat. No. 4,252,501 issued to Peill on Feb. 24, 1981 entitled HOLLOW COOLED VANE FOR A GAS TURBINE ENGINE discloses a vane with a vane having a forward section and a rearward section separated by an apertured web (23 in this patent), the forward section having a first tube (insert) and the rearward section having a second tube (insert). The second tube is divided into two cavities by a partition (31), with one of the cavities facing the suction side and the other cavity facing the pressure side. Cooling air supplied to the first tube provides impingement cooling to the forward section, then passes through the apertured web and into the suction side tube, and then through the impingement holes to provide impingement cooling to the suction side wall of the rearward section. A separate supply of cooling air is delivered through the pressure side cavity in the second tube and through holes to provide impingement cooling for the pressure side wall in the rearward section. The Peill patent shows the basic concept of multiple insert cooling of the present invention, but still requires a large amount of cooling air, and also is not as efficient as the present invention design.

BRIEF SUMMARY OF THE INVENTION

A turbine vane having a single cavity in which an insert assembly is secured. The insert assembly is divided into a plurality of zones forming separate inserts. The insert is supported by stand-off members that extend from the vane wall and form separate cooling passages. Cooling air is supplied to the forward-most insert impingement cavity, and flows through the holes to produce impingement cooling on the vane wall. Cooling air flows through the passage and is diverted into the second impingement cavity by the stand-off member. Cooling air that flows into the second impingement cavity then flows through the holes in it to produce impingement cooling of the vane wall. Air then flows in the passage between the insert and the wall and is diverted by a second stand-off into a third impingement cavity. Cooling air flows through holes in the third insert for impingement cooling of the vane wall. A fourth and a fifth impingement cavity can also be used in the insert assembly. Thus, a series flow through at least three impingement cavities is provided, which impingement cooling of the wall for each of the three sections, and a low amount of cooling air is required because the total flow area is at least one third than that of a single insert extending through the entire vane.

This unique multi-impingement insert baffle construction cooling mechanism provides the multi-impingement cooling arrangement for the airfoil vane, maximizes the usage of cooling air for a given airfoil inlet gas temperature and pressure profile. In addition, the use of total cooling for repeating the impingement process generates extremely high turbulence levels for a fixed amount of cooling flow, and therefore creates a high value of internal heat transfer coefficient. The multi-impingement cooling process yields a higher internal convective cooling effectiveness that the single pass impingement of the prior art airfoil vane cooling design.

DETAILED DESCRIPTION OF THE INVENTION

Figure 1:
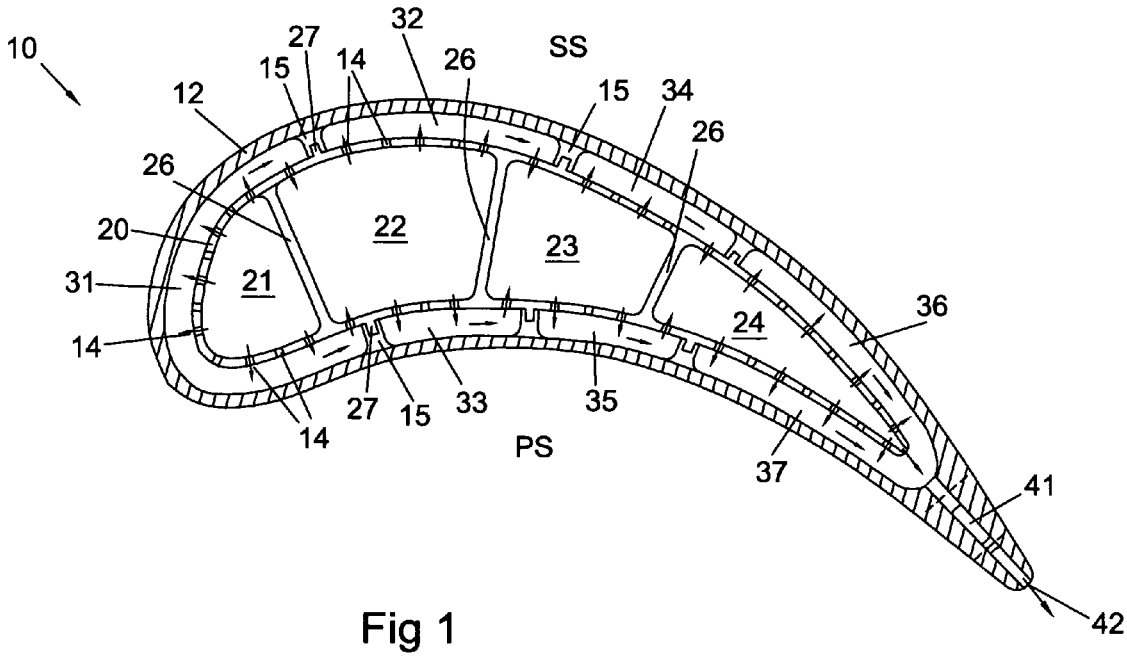
FIG. 1 shows a cut-away view of a vane having the multiple cavity insert of the present invention.

The stationary vane of the present invention is shown as a cut-away view in FIG. 1, where the vane 10 includes an outer wall 12 that forms the airfoil surface. Stand-offs 15 extends from the inner surface of the wall 12 and provides support for an insert 20. The stand-offs 15 have a groove formed therein in which a projecting member 27 of the insert fits to provide a seal. The insert 20 forms 4 impingement cavities and includes a first impingement cavity 21 located at the leading edge of the vane, a second impingement cavity 22 downstream from the first impingement cavity 21, a third impingement cavity 23 and a fourth impingement cavity 34. A fifth impingement cavity could also be formed within the insert, or the insert could have only three impingement cavities. Ribs 26 provide support for the insert 20 and form the separate impingement cavities. Each impingement cavity includes a plurality of hole to provide impingement cooling to the inner surface of the wall 12. All but the first impingement cavity also includes a plurality of holes to allow cooling air to flow into the impingement cavity. The second impingement cavity 22 has a cooling air inlet hole located upstream and next to the stand-off 27. The stand-offs 27, besides supporting the insert and forming a seal in the passages formed between the wall 12 and the insert 20, also act to force the cooling air into the impingement cavity 22. The third impingement cavity 23 and fourth impingement cavity 24 includes a plurality of cooling air inlet holes located just upstream from the stand-off 27.

The insert as shown in FIG. 1 is formed as a single piece and of standard materials with the thickness as used in inserts of the prior art. The first rib separating the first impingement cavity 21 and second impingement cavity 22 is a rearward rib for the first impingement cavity 21 and a forward rib for the second impingement cavity 22. The second rib located between the second cavity 22 and third cavity 23 is a rearward rib for the second cavity 22 and a forward rib for the third cavity 23.

A first impingement cooling passage 31 is formed between the wall 12, the insert 20, and the first set of stand-offs 15. A second impingement suction side cooling passage 32 is formed between the wall 12, the insert 20, the first stand-off 15, and a second stand-off, with a second impingement pressure side cooling passage 33 formed on the pressure side. A third impingement suction side cooling passage 35 is formed between the wall 12, the insert 20, the second stand-off, and a third stand-off, with a third impingement pressure side cooling passage 33 formed on the pressure side. A fourth impingement suction side cooling passage 36 is formed between the wall 12, the insert 20, the third stand-off, and a trailing end cooling exhaust passage 41, with a fourth impingement pressure side cooling passage 37 formed on the pressure side. A trailing edge cooling discharge hole 42 is on the trailing edge, and a plurality of pins extend within the exhaust passage 41 to provide support and to produce turbulent flow in the passage 41. The groove formed in the stand-off 15 and the projection 27 on the insert 20 provides a seal for the cooling air between the wall 12 and the insert 20.

The operation of the insert assembly 20 is now described with respect to the FIG. 1. Cooling air is supplied to the vane in the first impingement cavity 21 and flows through the holes 14 to provide impingement cooling to the inner surface of the vane wall 12 within the first impingement cooling passage 31. The first impingement cooling cavity 21 is located at the leading edge side of the vane because this is the hottest section of the vane and the cooling air in the first cavity would be the coolest. This cooling air flows through the first impingement cooling passage 31 and into the second impingement cavity 22 through the holes upstream from the first stand-offs 15. Cooling air then flows through the second impingement cavity 22 and through the holes on the suction side and the pressure side into the second impingement suction side cooling passage 32 and the second impingement suction side cooling passage 33 to provide impingement cooling on the wall 12. The cooling air flows within the passages 32 and 33 and into the third impingement cavity 23 through the holes located upstream from the second stand-offs 15. The cooling air then flows through the third impingement cavity 23 and through the holes on the suction side and the pressure side into the third impingement suction side cooling passage 34 and the third impingement suction side cooling passage 35 to provide impingement cooling on the wall 12. The cooling air flows within the passages 34 and 35 and into the fourth impingement cavity 24 through the holes located upstream from the third stand-offs 15. The cooling air then flows through the fourth impingement cavity 24 and through the holes on the suction side and the pressure side into the fourth impingement suction side cooling passage 36 and the fourth impingement suction side cooling passage 37 to provide impingement cooling on the wall 12. Cooling air flowing in the passages 36 and 37 then flows through the trailing edge passage 41 and out the discharge holes 42 in the trailing end of the vane.

Cooling air thus flows through the first impingement cavity 21, picks up heat, and then through the second 22, the third 23, and the fourth impingement cavity 24 while progressively picking up heat to transfer the heat away from the vane wall 12 and into the cooling air exiting the vane.

Thus, a series flow occurs from the first impingement cavity to the fourth impingement cavity and provides impingement cooling to the wall in sections. The overall cooling air amount is lower than in the cited prior art vanes while providing at least the same amount of vane cooling. Because less cooling air amount is required, the engine efficiency is increased. Also, because the insert 20 is formed as a single piece, the insert can be easily placed within the vane and support is minimal.

I claim the following:

1. An insert for use in a turbine airfoil, comprising:

a first rib extending from a pressure side to a suction side of the insert and forming a first impingement cavity;

a second rib extending from the pressure side to the suction side of the insert and forming a second impingement cavity adjacent to the first impingement cavity;

a plurality of impingement cooling holes spaced along the insert in the first impingement cavity;

a first insert support member extending from an insert wall of the second impingement cavity;

at least one inlet cooling hole in the second impingement cavity wall of the insert and located between the first impingement cavity and the first insert support member; and, a plurality of impingement cooling holes in the second impingement cavity wall of the insert and located between the first insert support member and the second rib.

2. The insert of claim 1, and further comprising:

a third rib extending from the pressure side to the suction side of the insert and forming a third impingement cavity with the second rib;

a second insert support member extending from the insert wall of the third impingement cavity;

at least one inlet cooling hole in the third impingement cavity wall of the insert and located between the second impingement cavity and the second insert support member; and, a plurality of impingement cooling holes in the third impingement cavity wall of the insert and located between the second insert support member and the third rib.

3. The insert of claim 1, and further comprising:

the insert support member forms a seal between the insert and a projection of the wall of the vane.

4. The insert of claim 1, and further comprising:

the first impingement cavity is substantially the same flow area as the second impingement cavity.

5. The insert of claim 2, and further comprising:

the three impingement cavities have substantially the same flow area.

6. The insert of claim 1, and further comprising:

the flow area of the first inlet cooling hole in the second impingement cavity is substantially equal to one half the combined flow area of the film cooling holes in the first impingement cavity.

7. The insert of claim 2, and further comprising:

the flow area of the second inlet cooling hole in the third impingement cavity is substantially equal to the combined flow area of the film cooling holes in the second impingement cavity.

8. A turbine vane used in a gas turbine engine, the vane comprising:

a wall forming an airfoil surface of the vane and forming a hollow opening for passage of a cooling fluid;

a plurality of insert support members extending from the vane wall;

an insert having a first and a second rib extending from the sides to form a first impingement cavity and a second impingement cavity;

a plurality of impingement cooling holes located on an insert wall of the first impingement cavity;

a first insert support member extending from the insert wall of the second impingement cavity and engaging with the insert support member of the vane wall to provide a seal between the vane wall and the insert;

a cooling inlet hole located in the insert wall of the second impingement cavity at a location between the first insert support member and the first rib; and, a plurality of impingement cooling holes in the insert wall of the second impingement cavity at a location between the first insert support member and the second rib.

9. The turbine vane of claim 8, and further comprising:

a third rib extending from the insert sides and forming a third impingement cavity with the second rib;

a second insert support member extending from the insert wall in the third impingement cavity and forming a seal with the insert support member extending from the vane wall;

a second inlet cooling hole located in the insert wall of the third impingement cavity and located between the second rib and the second insert support member; and, a plurality of impingement cooling holes in the insert wall of the third impingement cavity at a location between the second insert support member and the third rib.

10. The turbine vane of claim 9, and further comprising:

a first impingement cooling passage formed between the vane wall and the insert wall of the first impingement cavity.

11. The turbine vane of claim 10, and further comprising:

a second impingement cooling passage formed between the vane wall and the insert wall of the second impingement cavity and including the inlet cooling hole of the third impingement cavity, and between the first insert support member and the second insert support member.

12. The turbine vane of claim 8, and further comprising:

the first and second impingement cavities have substantially the same flow areas.

13. The turbine vane of claim 9, and further comprising:

the three impingement cavities have substantially the same flow areas.

14. The turbine vane of claim 9, and further comprising:

a trailing edge impingement cavity located adjacent to the trailing edge of the vane;

a trailing edge insert support member extending from the trailing edge impingement cavity near the forward end of the cavity;

an inlet cooling hole in the insert wall of the trailing edge impingement cavity and located between the trailing edge insert support member and the foreword rib forming the trailing edge impingement cavity; and, a plurality of impingement cooling holes located in the insert wall of the trailing edge impingement cavity between the trailing edge insert support member and the trailing edge of the cavity.

15. A process for impingement cooling of a turbine vane, the turbine vane having an insert within a hollow section of the vane, the process comprising:

supplying cooling air to a first impingement cavity of the insert;

directing impinging air from the first impingement cavity formed in the insert onto an inner wall of the vane;

channeling the cooling air from the first impingement cavity into a second impingement cavity formed in the insert located adjacent to the first impingement cavity;

directing impinging air from the second impingement cavity onto the inner wall of the vane; and, channeling the cooling air from the second impingement cavity into a third impingement cavity of the insert located adjacent to the second impingement cavity.

16. The process for impingement cooling of a turbine vane of claim 15, and further comprising the step of:

supporting the insert within the vane by a seal means for directing the cooling air into the second impingement cavity and the third impingement cavity.

17. The process for impingement cooling of a turbine vane of claim 15, and further comprising the step of:

separating the impingement cavities in the insert by ribs extending from a pressure side to a suction side of the insert.

18. The process for impingement cooling of a turbine vane of claim 15, and further comprising the steps of:

channeling cooling air into a trailing edge impingement cavity;

directing impinging air from the trailing edge impingement cavity onto the inner wall of the vane on the suction side and the pressure side; and, discharging the cooling air from the trailing edge impingement cavity through a trailing edge discharge hole.

19. The process for impingement cooling of a turbine vane of claim 15, and further comprising the step of:

the step of directing impinging air from the first impingement cavity formed in the insert onto the inner wall of the vane includes directing the impinging air onto the inner wall surface of the leading edge of the vane.

20. The process for impingement cooling of a turbine vane of claim 15, and further comprising the steps of:

the steps of directing impinging air from the second impingement cavity onto the inner wall of the vane and, channeling the cooling air from the second impingement cavity into a third impingement cavity of the insert located adjacent to the second impingement cavity, further comprises:

directing impingement air from the second impingement cavity onto the inner wall of the suction side through suction side impingement holes and directing impingement air from the second impingement cavity onto the inner wall of the pressure side through pressure side impingement holes.

* * * * *